United States Patent [19]

Tanabe

[11] Patent Number: 4,506,119

[45] Date of Patent: Mar. 19, 1985

[54] SNAP ACTION SLIDE SWITCH WITH WIPING ACTION

[75] Inventor: Yoshio Tanabe, Miyagi, Japan

[73] Assignee: Alps Electric Co., Ltd., Tokyo, Japan

[21] Appl. No.: 519,683

[22] Filed: Aug. 2, 1983

[30] Foreign Application Priority Data

Aug. 3, 1982 [JP] Japan ..... 57-117349[U]

[51] Int. Cl.[3] ..... H01H 15/00; H01H 21/04

[52] U.S. Cl. ..... 200/16 C; 200/16 D; 200/68.2; 200/68.3; 200/241; 200/242; 200/253; 200/275

[58] Field of Search ..... 200/16 C, 16 D, 68.2, 200/68.3, 241, 253, 275, 242, 154

[56] References Cited

U.S. PATENT DOCUMENTS

| | | | |
|---|---|---|---|
| 2,966,560 | 12/1960 | Gluck | 200/16 C |
| 3,072,757 | 1/1963 | Gluck | 200/16 D |
| 3,284,582 | 11/1966 | Hill et al. | 200/5 |
| 3,330,930 | 7/1967 | Hill et al. | 200/166 |
| 4,072,834 | 2/1978 | Godfrey | 200/16 C |

*Primary Examiner*—E. A. Goldberg
*Assistant Examiner*—Frederick L. Kampe
*Attorney, Agent, or Firm*—Guy W. Shoup; Gerard F. Dunne

[57] ABSTRACT

A slide switch having at least one row of terminals arranged along a substrate has a slider movable along the terminals. The slider carries a movable contact element biased resiliently towards the terminals so as to connect separate pairs of these terminals electrically together during movement of the slider. Each of the terminals has an exposed contact portion having an arcuate surface and the movable contact element has a generally corrugated shape formed by three arcuate protrusions forming convex surfaces facing the terminals and each spaced by trough portions presenting concave surfaces facing the terminals. In this way, the arcuate surfaces of the exposed contact portions can be adapted to fit within the trough portions upon movement of the slider into particular positions so as to stabilize the slider in these positions. Additionally, means are provided for pivoting the movable contact element as it disengages from an exposed contact portion so that the terminal last engages the movable contact portion at a location different than such engagement when the slider is in an associated stable position.

9 Claims, 11 Drawing Figures

SNAP ACTION SLIDE SWITCH WITH WIPING ACTION

BACKGROUND OF THE INVENTION

The present invention relates to a slide switch, and more particularly to a simplified switch structure.

A prior-art switch of the pertinent type is shown in FIG. 1. Referring to the figure, a terminal plate 1 has three terminals 2, 3 and 4 riveted thereto, and a movable contact piece 5 may move into engagement with the terminal. The movable contact piece 5 is attached to a slider 7 with a compression spring 6 received on its central part, and the resultant slider 7 is guided within a switch case 8 so as to perform sliding movements along the plate 1. A leaf spring 9 moves along with the slider 7. When the top 10 of the spring 9 has come to engage notches 11 provided in the switch case 8, the movable contact piece 5 is held in a position where the terminals 2, 3 and 4 are held open. When the slider 7 has moved rightwards or leftwards to stop in engagement within the switch case 8, the movable contact piece 5 short-circuits the terminals 2 and 3 or the terminals 3 and 4. With such structure, since the leaf spring 9 is required for stopping the movement of the slider, the number of components increases to that extent, and an additional stage of assemblage is needed. Moreover, both the end parts of the movable contact piece 5 must be formed nearly in the shape of right angles. When the end part touches with or separates from the terminal 2 or 4, an arc electric may be produced to locally roughen both the movable contact piece and the terminal and to adversely affect the feeling of a switching operation.

SUMMARY OF THE INVENTION

An object of the present invention is to provide a slide switch which affords proper click feeling and reliable engagement as well as stable contact touch, with a simplified structure.

According to the present invention, a corrugated movable contact piece having three arcuate protrusions is employed. In the state in which the movable contact piece short-circuits two fixed terminals, the sideward ones of the three protrusions abut on the contact portions of the respective terminals, or the contact portion of one of the two fixed terminals is held in abutting engagement with the side walls of the trough between the adjacent ones of the three protrusions. In the latter situation, the inclined surface of that end part of the movable contact piece which lies on the same side as the central protrusion thereof with respect to the trough abuts on the inclined face of the contact portion of the fixed terminal located sidewards. This state of abutting engagement permits the operator of the slide switch to sense the touch between the two terminals, and brings forth the reliable engagement between the movable contact piece and the terminals. In the course of the shift between such short-circuited states or the shift from the short-circuited state into a separated state or vice versa, the movable contact piece gives rise to a rubbing motion with the fixed terminal along the arcuate face thereof. Thus, the contact surfaces of both the contact members are cleaned to lessen the roughening of these contact members due to an electric arc struck and to realize a smooth switching operation. Moreover, the stable touch between the contact members is ensured.

PREFERRED EMBODIMENT OF THE INVENTION

An embodiment of the present invention will now be described with reference to the drawings.

Figure 1:
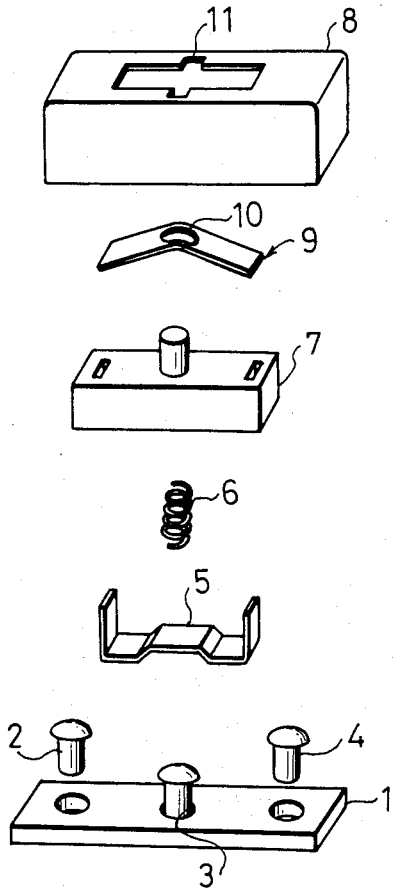
Fig.1 PRIOR ART
FIG. 1 is an exploded perspective view showing a prior-art slide switch.
Figure 2:
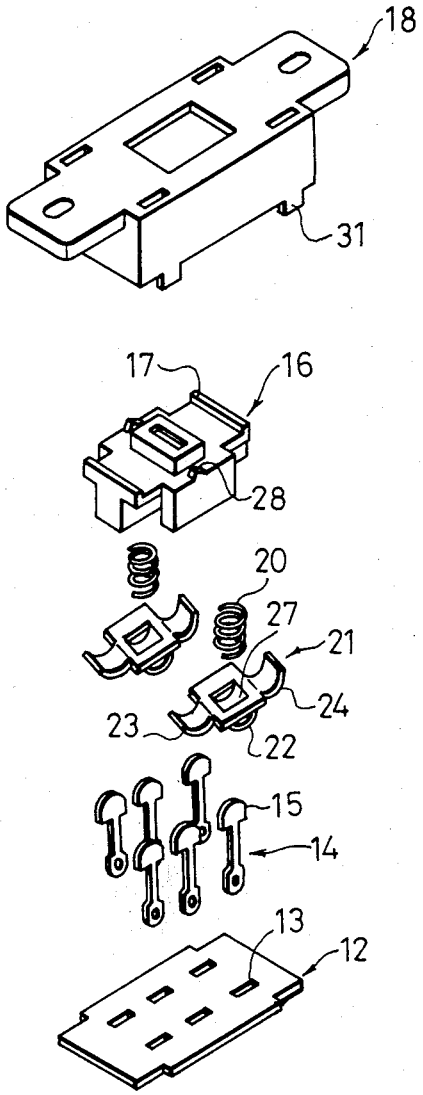
FIG. 2 is an exploded perspective view of a slide switch showing an embodiment of the present invention.
Figure 3:
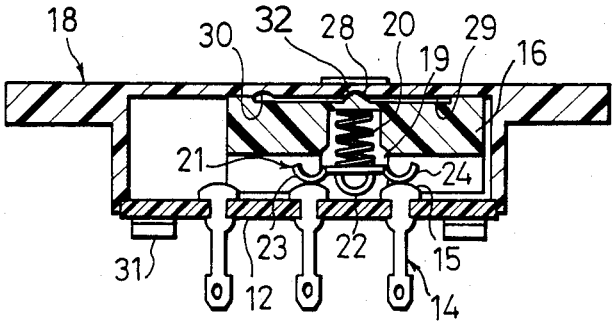
FIG. 3 is a sectional front view showing the assembled state of the embodiment of FIG. 2.
Figure 4:
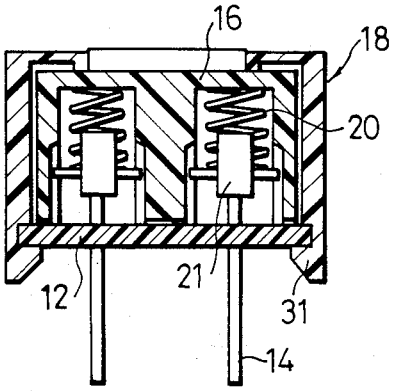
FIG. 4 is a sectional side view of the embodiment assembled.

In FIG. 2, a terminal plate 12 is made of an electric insulator and is provided with six terminal-mounting holes 13, in which fixed terminals 14 are respectively inserted and caulked as shown in FIG. 3. Each of the terminals 14 has a contact portion 15 formed with an arcuate face, and such terminals are arrayed in two rows (double pole) each having three of the terminals located at equal intervals. A slider 16 is made of an electrically-insulating molded material, and has sliding portions 17. It is received in a switch case 18 which is also molded, and is adapted to slide in the longitudinal direction of the switch case 18. On respective sides of the sliding axis of the slider 16, cavities 19 are provided as shown in FIGS. 3 and 4. One end of a compression spring 20 is retained at the central part of the upper wall of each cavity 19. Each of two movable contact pieces 21 is provided with a central protrusion 22 and end protrusions 23 and 24 on respective sides thereof. The end protrusions 23 and 24 are corrugated, i.e. bent in an upwardly-opening curved configuration, as shown in FIGS. 2 and 3. The height of the crests of the protrusions 23 and 24 on both the sides is equal to the height of the terminals 14. As illustrated clearly in FIGS. 5B and 5F, trough portions 25 and 26 are formed between the protrusions 22 and 23 and between protrusions 22 and 24, respectively. These trough portions open downwardly and are adapted to receive the crown portions of the contact portions 15 of the terminals 14, as shown clearly in FIG. 5B. At this time, the inclined surface of the end part of the sideward protrusion 24 or 23 abuts on the inclined surface of the contact portion adjoining the particuar contact portion 15. The movable contact piece 21 is provided with a spring receiving portion 27 in opposition to the central protrusion 22, and the other end of the compression spring 20 is retained therein. The cavity 19 of the slider 16 is wide enough to allow the compression spring 20 to cause necessary lateral buckling as shown in FIG. 3. The slider 16 is formed with two (one set of) saliences 28 in the upper central parts thereof. On the other hand, the switch case 18 is formed with two sets of recesses 30 and 32 for receiving the saliences 28, in a sliding surface 29 for guiding the slider 16. The positions of the recesses 30 and 32 are so set that, in the state in which these recesses receive the saliences 28, the terminals 14 are short-circuited in engagement with the movable contact pieces 21 as shown in FIG. 3. As shown in FIG. 4, the switch case 18 is formed with hook-shaped portions 31 for mounting the terminal plate 12. This terminal plate 12 is mounted by being snaped into the mounting portion 31.

Figure 5A:
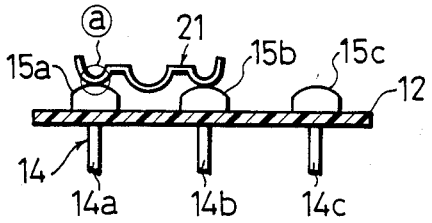
FIGS. 5A to 5G are schematic views for explaining the switching operations of the embodiment.
Figure 5B:
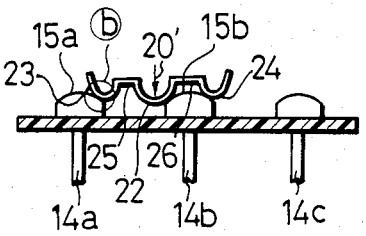
Figure 5C:
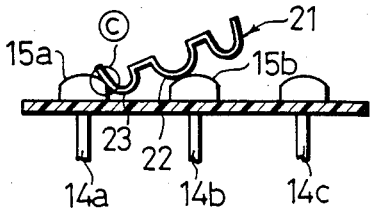
Figure 5D:
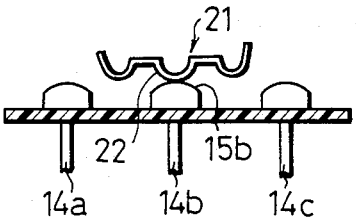
Figure 5E:
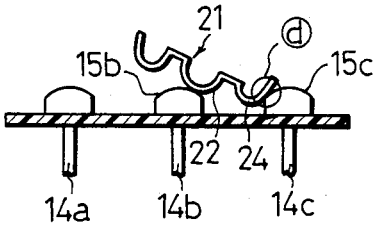
Figure 5F:
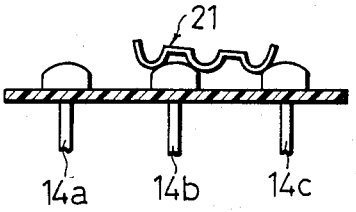
Figure 5G:
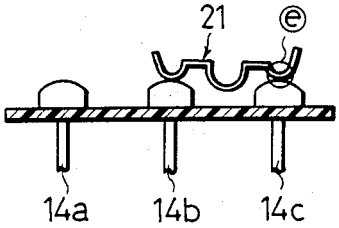

The operation of the slide switch thus constructed will now be described. FIG. 5A illustrates that the movable contact piece 2 may be balanced between the terminals 14*a* and 14*b* to short-circuit these terminals while being held in a stationary state. In this state, the movable contact piece 21 engages both the terminals in equally pressed contact, and the salience 28 of the slider 16 is held in engagement with the recess 30 of the switch case 18. When, from this state, the slider 16 is moved rightwards, the movable contact piece 21 receives the contact portion 15*b* of the terminal 14*b* between both the side walls of the trough 26, and the protrusion 23 thereof somewhat falls along the arcuate face of the contact portion 15*a* of the terminal 14*a*, as illustrated in FIG. 5B. More specifically, a pressure angle, which is brought forth at the point of contact of the protrusion 22 with the contact portion 15*b* by the shape of this contact portion with respect to the line of application 20' of the compression spring 20 indicated by an arrow, causes compression of the compression spring 20. Thus, the movable contact piece 21 undergoes a counterclockwise turning force, and its point of contact with the contact portion 15*a* shifts from a state a into a state b and holds the contact portion 15*a* in pressed contact. When the slider 16 is further moved rightwards, the protrusion 22 moves into the contact portion 15*b* along the arcuate face thereof as shown in FIG. 5C. In addition, the compression spring 20 is compressed, and the point of contact between the protrusion 23 and the contact portion 15*a* shifts into a state c. When the slider 16 is further moved rightwards, the terminals 14*a* and 14*b* are separated as shown in FIG. 5D. At the separation, an electric arc may be struck at the point of contact c to degrade the contact at this point of contact c. Besides, in the course of the shift from the state of FIG. 5B into the state of FIG. 5D, a stress is applied to the compression springs due to the movable contact piece 21 moving upwardly along the arcuate face of the contact portion 15*b*. When the slider 16 is further moved righwards, the movable contact piece 21 is similarly turned clockwise by a pressure angle to come into touch with the contact portion 15*c* at a point of contact d as shown in FIG. 5E. Likewise to the above, arcing and contact degradation may occur at the point of contact d. When the slider 16 is further moved rightwards, the aforementioned stress disappears, and a state of FIG. 5F similar to the state of FIG. 5B is established. Here, the movable contact piece 21 falls into a stable state, and the change-over of the contacts can be reliably sensed. Further, as shown in FIG. 5G, the movable contact piece 21 may become balanced between the terminals 14*b* and 14*c* to short circuit these terminals. At this time, the salience 28 of the slider 16 is in the stationary state in which it is held in engagement with the recess 32 of the switch case 18, and one double-pole short-circuited state shown in FIG. 5A has been changed-over into the other double-pole short-circuited state shown in FIG. 5G. A point of contact e at this time differs in position from that d. This embodiment is so constructed that the slider 16 and the switch case 18 are held from moving from the states of FIGS. 5A and 5G. In the states of FIGS. 5B and 5F, the movable contact piece 21 falls in between the adjacent ones of the contact portions 15*a*, 15*b* and 15*c*, to retard the leftward and rightward movements of the movable contact piece 21, respectively.

As set forth above, according to the present invention, proper click feeling in a switching operation and reliable engagement in a stationary state are attained with a simple structure. Since a position where contacts (the protrusion of a movable contact piece and the contact portion of a terminal) touch in the stationary state is different from a position where the contacts are degraded by an electric arc at the switching operation, inferior touch etc. ascribable to the roughening of the contacts are not feared. Moreover, the movable contact piece slides properly between the contact portions of the terminals during the switching operation, and the sliding contributes to the action of cleaning the contact piece and the contact portions. In this regard, the cleaning might be thought unnecessary in such a case where the slide switch of the present invention is used for selecting either of two different power sources almost permanently in accordance with the specifications of a circuit device to which it is applied. Even in the case, the contacts will become contaminated to give rise to inferior touch because of the use of the slide switch in a fixed contact touch state over a long term. In order to cope with this drawback, the contacts can be cleared by repeatedly establishing the state of FIG. 5F and that of FIG. 5G which can both be sensed in the operation of the slider 16.

What is claimed is:

1. A slide switch comprising:

a switch case;

a terminal place made of an electric insulator and fixed to said switch case;

a plurality of fixed terminals fixed in said terminal plate so as to be arrayed at equal intervals, each of said fixed terminals having a contact portion formed with an arcuate face;

a slider made of an electric insulator, said slider being received within said switch case and adapted to be guided by said switch case so as to move along the array of said terminals;

a movable contact piece received in a cavity of said slider, said movable contact piece having a corrugated shape including three arcuate protrusions, said movable contact piece being such that side walls of a trough formed between a central one of the protrusions and a respective sideward protrustion is adapted to abuttingly receive the arcuate face of said contact portion of one of said fixed terminals, that in the state in which said contact portion of said one fixed terminal is received, an inclined surface of that end part of said movable contact piece which lies on the same side as said central protrusion thereof with respect to said trough can abut on the inclined face of the contact portion of the fixed terminal adjoining said one fixed terminal, and that said movable contact piece can touch only said contact portion of said one fixed terminal, depending upon positions of the movement thereof; and a compression spring which has its one end retained in opposition to said central protrusion of said movable contact piece and its other end retained in said cavity of said slider, said compression spring being adapted to hold said movable contact piece in pressed ocntact with the contact portions to permit said movable contact piece to turn in accordance with a pressure angle at the pressed contact between the arcuate face of said contact portion and the central protrusion of said movable contact piece.

2. A slide switch according to claim 1, wherein the height of the crests of said protrusions of said movable contact piece is equal to the height of said fixed terminals.

3. A slide switch according to claim 1, wherein said central protrusion of said movable contact piece is formed by cutting and erecting a part of a plate material of said movable contact piece.

4. A slide switch according to claim 1, wherein said one end of said compression spring is retained in a recess formed by said central protrusion of said movable contact piece.

5. A slide switch according to claim 1, wherein said central protrusion of said movable contact piece bulges more than the sideward protrusions thereof.

6. A slide switch according to claim 1, wherein a salience is formed in a central upper part of said slider, and two sets of recesses for receiving said salience are formed in said switch case.

7. A slide switch according to claim 1, wherein said each fixed terminal is formed to be flat as a whole.

8. In a slide switch as defined in claim 1, a double-pole slide switch which further comprises the movable contact piece with the compression spring, and in which the fixed terminals are arrayed in two rows.

9. In a slide switch having at least one row of terminals arranged along a substrate and a slider movable along said terminals and carrying a movable contact element biased resiliently towards said terminals so as to connect separate pairs of said terminals electrically together durng movement of said slider, the improvement wherein each of said terminals has an exposed contact portion having an arcuate surface and said movable contact element having a generally corrugated shape formed by three arcuate protrusions forming convex surfaces facing said terminals and each spaced by trough portions presenting concave surfaces facing said terminals, wherein said arcuate suface of said exposed contact portions are adapted to fit within said trough portions upon movement of said slider into particular positions so as to stabilize said slider in said positions, and means for pivoting said movable contact element as it disengages from an exposed contact portion so that said terminal lastly engages the movable contact portion at a location different that such engagement when said slider is in an associated stable position.

* * * * *